United States Patent [19]

Kuniskis

[11] Patent Number: 5,022,386

[45] Date of Patent: Jun. 11, 1991

[54] PORTABLE MASSAGE TABLE

[76] Inventor: Casemiro A. Kuniskis, 2328 E. Van Buren, Suite 125, Phoenix, Ariz. 85006

[21] Appl. No.: 571,712

[22] Filed: Aug. 24, 1990

[51] Int. Cl.[5] ..... A61H 15/00

[52] U.S. Cl. ..... 128/57; 128/24 R; 128/33; 128/51; 128/52

[58] Field of Search ..... 128/24 R, 33, 44, 52, 128/55, 57, 46, 49, 60, 61, 51

[56] References Cited

U.S. PATENT DOCUMENTS

| | | | |
|---|---|---|---|
| 721,737 | 3/1903 | Ownes . | |
| 731,693 | 6/1903 | Lennox | 128/57 |
| 1,175,513 | 3/1916 | Flynt . | |
| 1,399,034 | 12/1921 | Taplin | 128/60 X |
| 1,593,014 | 7/1926 | Bushmiller . | |
| 1,817,077 | 3/1929 | Gustaneson | 128/57 |
| 2,461,102 | 2/1949 | Ackerman | 128/57 |
| 2,889,826 | 6/1959 | Russo | 128/57 |
| 3,164,150 | 1/1965 | Reid | 128/57 |
| 3,289,673 | 12/1966 | Russo | 128/57 |
| 3,403,674 | 10/1968 | Alimanestiano | 128/61 |
| 3,672,357 | 6/1972 | Ferguson | 128/49 |
| 3,817,243 | 6/1974 | Perrine | 128/57 |
| 4,041,938 | 8/1977 | Wintoniw | 128/52 |
| 4,721,100 | 1/1988 | Hengl | 128/52 |

FOREIGN PATENT DOCUMENTS 2166351A 12/1990 United Kingdom .

*Primary Examiner*—Robert A. Hafer
*Assistant Examiner*—David Kenealy
*Attorney, Agent, or Firm*—Warren F. B. Lindsley

[57] ABSTRACT

A massaging machine employing a rack for supporting a horizontal track over which motor driven pivotally mounted sprocket is moved. The sprocket drives a trolley which trolley supporting a roller mechanism which follows the contour of a user lying prone on a table supporting the rack on one side thereof. The trolley is returned to a motor drive position under the action of a weighted cable when the sprocket is pivotally moved away from the track at the end of a motor driven massage activity.

8 Claims, 4 Drawing Sheets

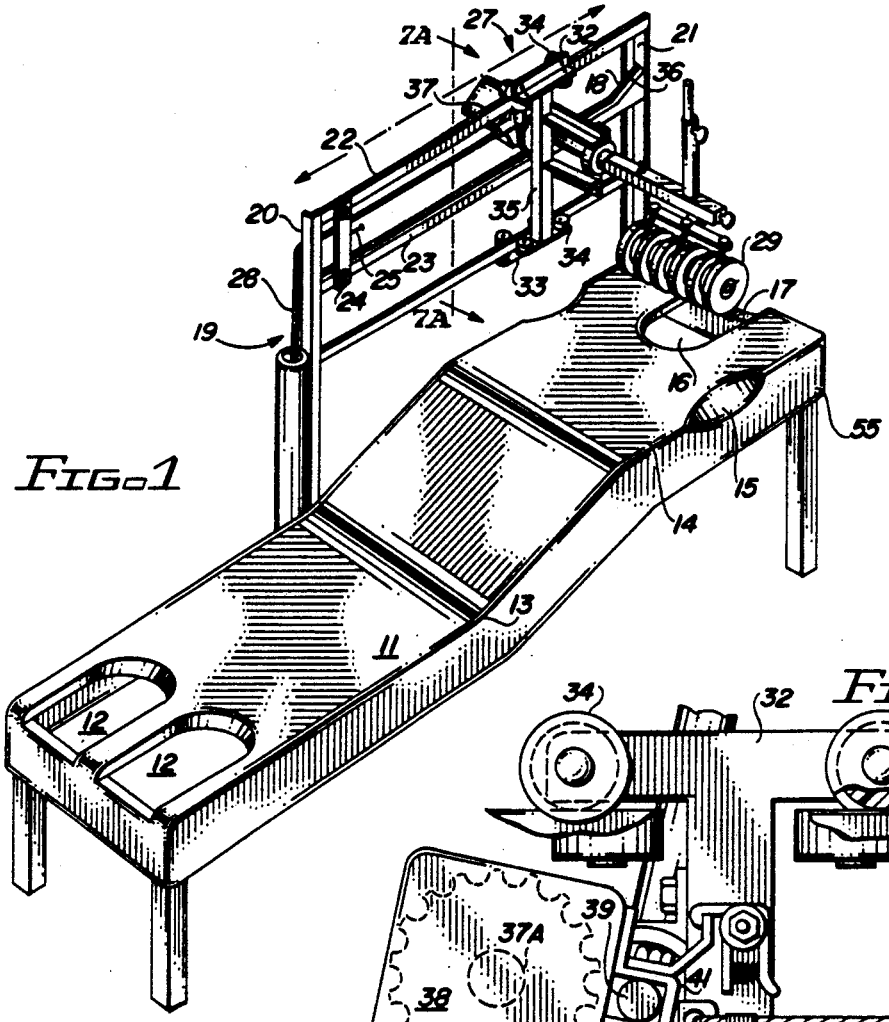
FIG. 1
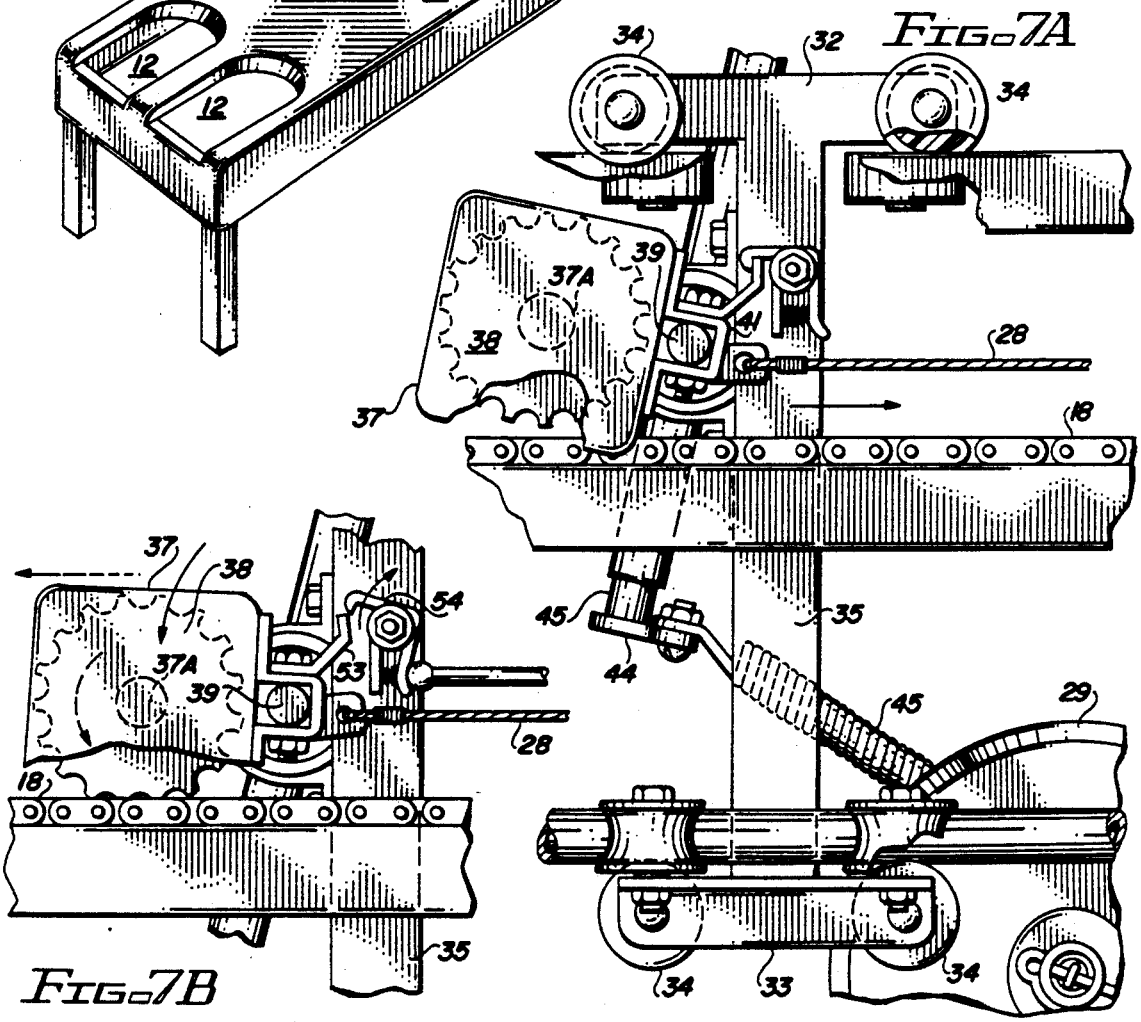
FIG. 7A
FIG. 7B

PORTABLE MASSAGE TABLE

BACKGROUND OF THE INVENTION

This invention relates to massage tables and more particularly to massaging apparatus for use upon the human body.

It is well known to those skilled in the art that numerous massaging machines have been developed for massaging the human body in an attempt to stimulate circulation, tone up the muscles and to improve the general health of the user wherein the machine rolls against the body, oscillates rotationally or simply vibrates. However, none of these movements can equal the massaging qualities obtainable by the human hands of the masseur. Accordingly, an ideal massage by mechanical means has yet to be developed.

DESCRIPTION OF THE PRIOR ART

U.S. Pat. No. 4,721,100 discloses a massaging machine in which a brush rotates about a horizontal axis and massages a person lying below the brush. The brush is also slidable horizontally along a frame and movement is controlled by an electric motor.

United Kingdom patent application GB 2 166 351A provides a massaging apparatus including a motor actuated movable carriage, carrying massaging means, driven to move reciprocally above a supporting frame to apply rubbing motion to the back of a user who lies face down on the supporting frame.

U.S. Pat. No. 1,175,513 discloses a massage apparatus whereby pulling handles cause cables to overcome the bias of springs and move the unit over the body of the user.

U.S. Pat. No. 3,164,150 discloses a massage and exercise table in which a roller structure is moved back and forth by pressing the feet of a user against a foot board which operates against the bias of resilient members.

U.S. Pat. No. 3,672,357 discloses a motor operated massage apparatus in which the user lies face down while a carriage moves back and forth above the user while applying a massage.

The following patents, although of interest, are not believed to be anticipatory of the invention claimed:

| | |
|---|---|
| 3,817,243 | 2,461,102 |
| 3,403,674 | 1,593,014 |
| 2,889,826 | 721,737 |

SUMMARY OF THE INVENTION

In accordance with the invention claimed, a new and improved massage table is disclosed which stimulates and tones the muscles to improve the general health of the user.

It is, therefore, one object of this invention to provide a new and improved massage apparatus.

Another object of this invention is to provide a new apparatus for massaging the human body which may be operated either by an attendant or by the person using the machine.

A further object of this invention is to provide an improved massage machine that is easily and economically produced, sturdy in construction and highly efficient in operation.

A still further object of this invention is to provide a massage table that is adjustable to massage various parts of the human anatomy.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily describe by reference to the accompanying drawings, in which:

FIG. 1 is a top perspective view of the massage table disclosed shown in operative position and embodying the invention;

FIG. 7A is an enlargement of the circled area 7A of FIG. 6C;

FIG. 7B is an enlargement of the circled area 7B of FIG. 6A; and

DESCRIPTION OF THE PREFERRED EMBODIMENT

Figure 2:
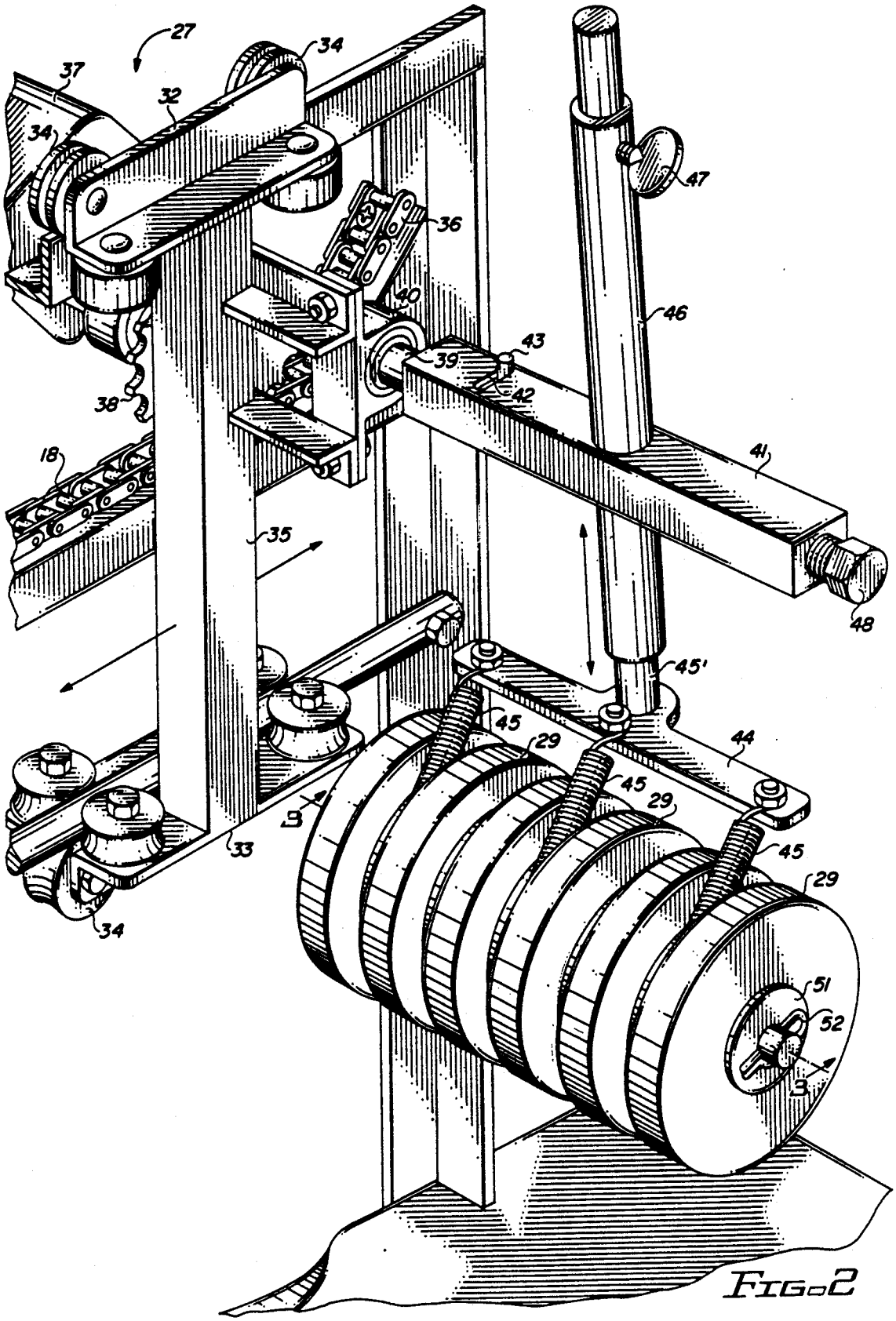
FIG. 2 is an enlarged perspective view of the right end of the table shown in FIG. 1.

Referring more particularly to the drawings by characters of reference, FIGS. 1-8 disclose a portable massage table 10 comprising an angular rest surface 11 on which a user reclines usually face down which surface is provided with cutouts 12 for the user's feet. The center portion of surface 11 rises at 13 and levels off at 14 for support of the upper part of the body of a user. Relieved areas 15 on each side of raised surface 14 are provided for the arms of the user. Cutout 16 of surface 11 allows the head of a user to be lowered and the forehead to rest against a rest 17. Cutout 16 and rest 17 are important to allow the head of a user to be slightly lower than the rest of his or her body to allow the rollers of the massage table to pass over the back, neck and head of a user as the rollers move along track 18.

Attached to the left side of table 10, as shown in FIG. 1, is mounted a frame 19 comprising vertically positioned legs 20 and 21 having cross members 22 and 23 connected thereto which act as a part of longitudinal track 18. Horizontal frame member 23 supports chain track 18. A vertical bracket 24 is positioned across the left ends of frame members 22 and 23 for supporting a latch activating pin 25.

A trolley mechanism 27 actuated by a cable 28 shown more clearly in FIGS. 7A and 7B moves along track 18 and carries with it a plurality of massage rollers 29. A hollow tube or cylinder 30 positioned adjacent member 20 houses a weight 31 shown in FIG. 8 which is attached to pully attachment 27 by cable 28.

This trolley mechanism comprises a pair of carriages 32 and 33 each supporting at least a pair of guide rollers 34 which are spaced apart by a frame member 35 such that the carriages ride along frame members 22 and 23. This trolley type mechanism moves longitudinally of the massage table along members 22 and 23 between latch or activating pin 25 at one end of frame 19 to raised portion 36 of track 18 at the other end of frame 19.

As shown in FIGS. 1 and 2, the trolley mechanism 27 is driven along track 18 by a gear motor 37 through the rotation of its shaft 37A which is connected to sprocket 38 for rotation therewith.

In order to raise and lower the massage rollers 29, its assembly is mounted on a rotatable shaft 39 which is journalled in bearing means 40 mounted on frame member 35 of trolley mechanism 27.

Shaft 39 extends into a four sided tube 41 which is provided with a slot 42 through which a pin 43 extending laterally from shaft 39. This pin limits the rotational movement of shaft 39 to the length of slot 42.

Rollers 29 are mounted in a cylindrical configuration and are resiliently suspended from a support plate 44 by a plurality of coil springs 45. Support plate 44 is attached to a laterally extending shaft 45' which is movably mounted in a cylindrical housing 46 and adjustably positioned therein by a set screw 47.

The four sided tube 41 is firmly held in place on housing 46 by a bolt or thumb screw means 48 which extends into tube 41 and against housing 46 in a known manner. Thus, the massage rollers may be adjustably mounted up or down along housing 46 to compensate for the contour of the user over which they move.

Figure 3A:
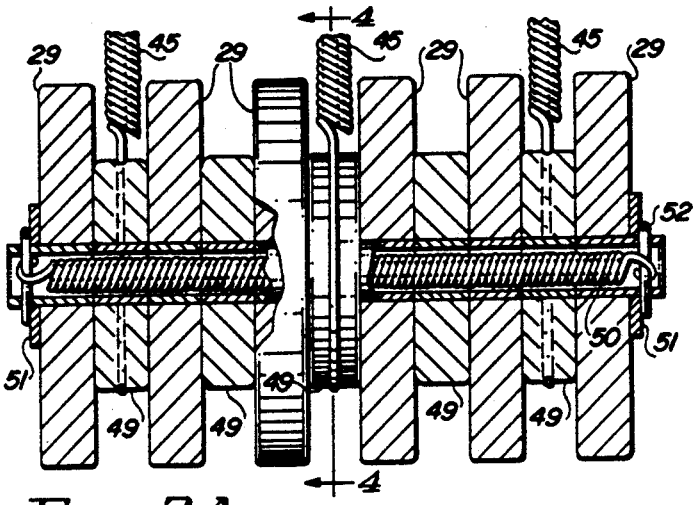
FIG. 3A is a cross sectional view of the massage rollers shown in FIG. 1.
Figure 3B:
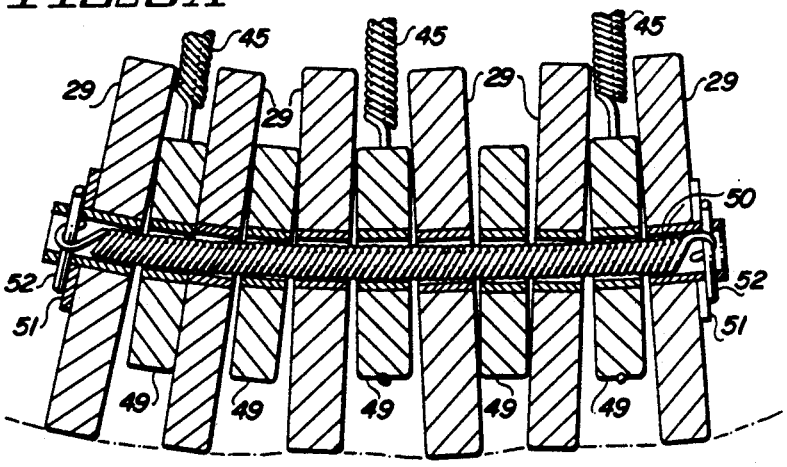
FIG. 3B is a cross sectional view similar to FIG. 3A with the rollers in a massaging position on the user.

As noted from FIGS. 3A and 3B, the cylindrical assembly of massage discs or rollers 29 are separated by spacers 49 all apertured through their centers and held together in a loose arrangement by a coil spring 50 each end of which is attached to a thrust washer 51 and held thereon by a cotter pin 52.

As noted from FIG. 3B, the roller assembly may distort when moving over the body of a user to accommodate the changing body contours and spring 50 is able to flex allowing this to happen.

Figure 4:
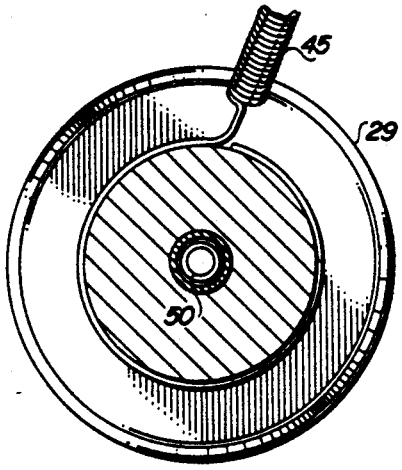
FIG. 4 is a cross sectional view of FIG. 3A taken along the line 4—4.

FIG. 4 illustrates how the ends of springs 45 are wrapped around and retained on spacers 49.

Figure 5A:
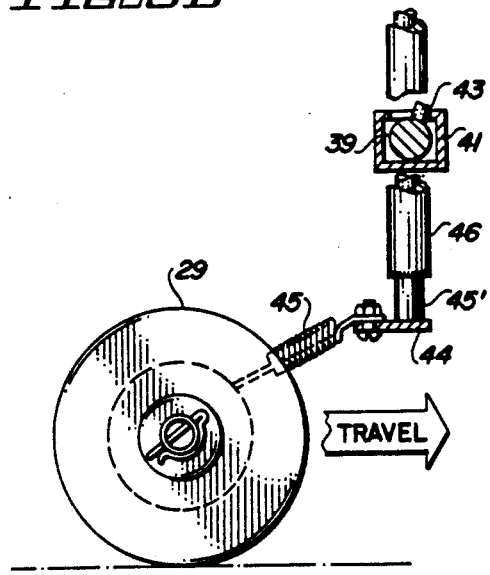
FIG. 5A is a right end view of the roller control mechanism shown in FIG. 1 with the rollers lowered onto the lower back of a user and ready to travel and rotate towards the head end of the user.
Figure 5B:
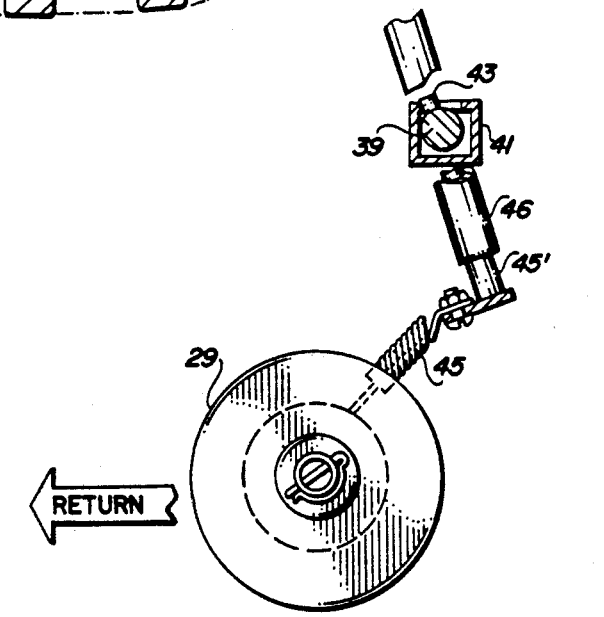
FIG. 5B is a view similar to FIG. 5A of the roller control mechanism with the rollers raised at the head end of the patient, ready to be returned to the position shown in FIG. 1.

FIG. 5A illustrates the position of the massage rollers and their control mechanism as they travel over the body of the user in contact therewith and FIG. 5B illustrates the position of the massage rollers clearing the body for returning to the foot end of the user without physical contact with the user.

FIGS. 6A–6E and FIGS. 7A and 7B illustrate various positions of the trolley mechanism 27 as it moves along track 18 mounted on frame member 23 of massage table 10. It should be noted that the length of track 18 determines when the trolley is latched and unlatched from track 18.

Figures 6A, 6B, 6C, 6D, 6E, 8:
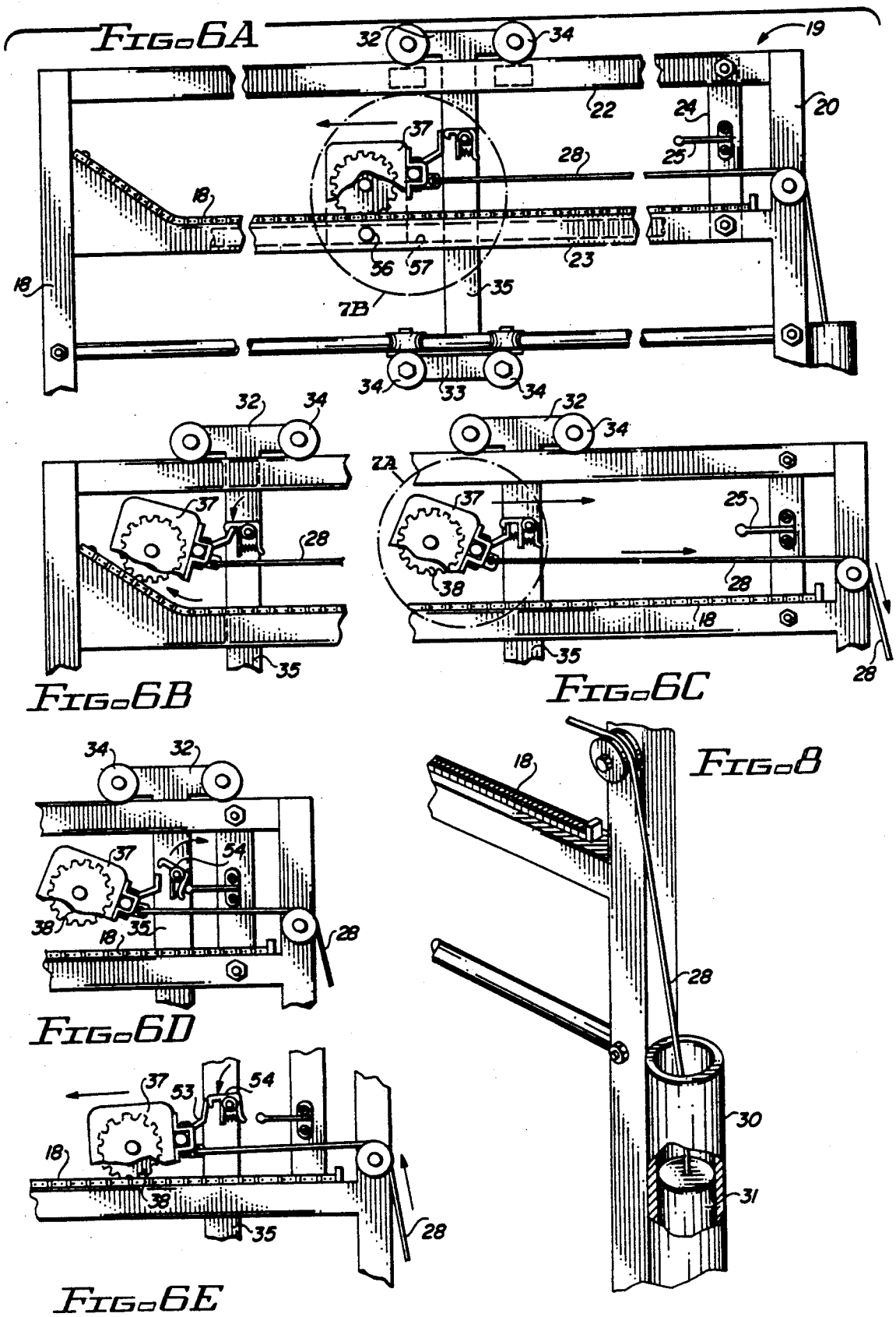
FIG. 6A is a front view of the upper frame and roller traveling mechanism shown in FIG. 1.
FIG. 6B is a partial view of the roller release mechanism showing the chain drive track incline ramp which causes a latch mechanism to close and weight cord to start return travel of rollers to lower back position.
FIG. 6C is a view similar to FIG. 6B with the roller release mechanism shown in roller raised position.
FIG. 6D is a view similar to FIG. 6B at the opposite end of the structure showing the bumper pin contacting the latch mechanism causing motor and roller mechanism to start a roller lowering pivotal movement.
FIG. 6E is a view similar to FIG. 6D showing the roller and motor pivot movement and sprocket engagement with the chain drive track.
FIG. 8 is an enlarged perspective view partially broken away of the return cable, guide tube and weight.

FIG. 6A illustrates a side view of frame 19 with trolley mechanism 27, its driving motor 37 and sprocket 38 in engagement with track 18 in the center of the table. With the motor energized, drive sprocket 38 is rotating thereby propelling trolley mechanism 27 and the massage rollers 29 from the lower back of the user to his or her neck area. It should be noted, as shown in FIG. 7A, that a latch is provided for latching motor 37 to the trolley mechanism and comprises a latch member 53 fastened to pillow block 41 and a catch 54 secured to frame member 35 of the trolley mechanism. In the unlatched position shown in FIGS. 6A and 7A the motor and its drive sprocket 38 are moving in unison with trolley mechanism 27 along track 18 with the massage rollers riding on the surface of the body of the user moving from the lower back to the neck area of the user.

When the motor and trolley mechanism on track 18 climb ramp 36, the latch components engage each other as shown in FIGS. 6B and 6C causing shaft 39 to rotate substantially the length of slot 42 in tube 41 with slot 42 controlling the amount of rotation of shaft 39. This amount of rotation causes the rollers 29 to lift off of the body of the user at the head end of the massage table ready to be returned to the foot end of the table by the action of gravity, namely the force of weight 31 on cable 28 which is attached to tube 41 at any suitable place along its length.

When the trolley mechanism reaches the foot end of the massage table the trolley mechanism's catch mechanism 54 engages pin 25 causing the catch mechanism 54 to rotate clockwise as shown in FIG. 6D and the motor, sprocket and latch member to become unlatched, as shown in FIGS. 6D and 6E. Unlatching motor 37 causes it and its sprocket 38 to rotate counterclockwise and to cause the sprocket under the action of gravity to engage track 18. Motor 37 then rotates sprocket 38 causing it to move massage rollers 29 over the contour of the user from the lower back to his or her head.

When the motor and trolley mechanism again reach the head of the massage table the parts of the latch mechanism again engage, as shown in FIGS. 6A, 6B and 6C, thereby rotating the motor and sprocket clockwise to release the sprocket from track 18 and permit the trolley and motor mechanism to be returned to the foot end of the massage table by the effects of weight 31 being dropped to the bottom of cylinder 30.

As noted from FIG. 6B, the gear motor and sprocket are guided and raised by chain track 18. As they are raised the bent latch member 53 swings in an arc and contacts the outside lower surface of catch 54. This surface acts as a cam surface hence raising the latch member 53 and permits this member to catch under catch 54. When this happens, cable 28 which is always under tension from weight 31 takes over and pulls the disengaged sprocket from track 18 causing the trolley with the massage rollers to move to the other end of frame 19 under the action of weight 31.

As shown in FIG. 1, a toggle on-off switch 55 is provided on the head of the massage table so that the user can control the energization of the motor and in turn the movement of the rollers 29.

It should be noted that a roller 56 may be arranged to extend outwardly from the housing of motor 37 as shown in dash lines in FIG. 6A for traveling in a channel 57 mounted below track 18 to prevent rising of the motor and sprocket of the mechanism off of the track and still fall within the scope of this invention.

Although but one embodiment of the invention has been illustrated and described, it will be apparent to those skilled in the art that various changes and modifications may be made therein without departing from the spirit of the invention or from the scope of the appended claims.

What is claimed is:

1. A massaging machine comprising:

a table for horizontally supporting a person to be massaged thereon, a vertically positioned frame mounted adjacent one side of said table, said frame comprising a horizontally positioned track having an elevating ramp at one end thereof, a trolley means mounted on said frame for movement horizontally therealong, a motor means pivotally mounted on said trolley means and comprising a rotatable shaft connected to a sprocket which is engageable with said track for rotation therealong in one direction upon rotation of said shaft, roller means connected to said trolley means and comprising an arm extending laterally across said table and a plurality of rollers mounted on said arm for engaging the contour of a person lying thereon when said trolley means is moving along said track in said one direction upon energization of said motor means, latch means having an arm and catch one of which is mounted on said motor means and the other on said trolley means for engagement when said sprocket rides up said ramp of said track causing said motor means to pivot relative to said trolley means, said motor means when latched to said trolley means elevating said sprocket off of said track, weighted cable means connected to said motor means for moving said trolley means above and along said track and elevated above the contour of said person in a second direction under the action of gravity after engagement of the arm and catch of said latch means, and means for unlatching said latch means when said trolley means reaches said other end of said track, thereby causing said sprocket means to engage said track and said motor means to drive said sprocket along said track in said one direction and said roller means over the contour of the person lying on said table.

2. The massaging machine set forth in claim 1 wherein:

said track comprising a linked chain.

3. The massaging machine set forth in claim 1 wherein:

said weighted cable means comprises a cylinder mounted vertically on said other end of said track, a weight movably positioned therein and a cable connected at one end to said weight and the other end connected to said motor means.

4. The massaging table set forth in claim 1 in further combination with:

means for restraining said sprocket on said track when it moves on said track in said one direction.

5. The massaging table set forth in claim 1 in further combination with:

means for adjusting said roller means vertically of said table.

6. The massaging table set forth in claim 1 wherein:

said trolley means comprises two pairs of spaced rollers each movable vertically along said frame.

7. The massaging table set forth in claim 1 wherein:

said roller means comprises a plurality of rollers axially aligned and each movable independently of the other.

8. The massaging table set forth in claim 7 in further combination with:

a plurality of spacer discs one positioned between each of said rollers and axially aligned therewith, and spring means one for each spacer connected at one end around the periphery of the associated spacer and at the other end to said arm in a spaced arrangement.

* * * * *